United States Patent [19]

Bauer, Jr. et al.

[11] 4,272,212

[45] Jun. 9, 1981

[54] METHOD AND APPARATUS FOR REJUVENATING AND RECYCLING ASPHALT

[75] Inventors: Andrew J. Bauer, Jr., 7937 Arnoldtown Rd., Louisville, Ky. 40214; John N. Doering, Louisville, Ky.

[73] Assignees: Andrew J. Bauer, Jr.; Andrew J. Bauer, III, both of Louisville, Ky.; Harold G. Shaw, Sr., Jeffersonville, Ind.; Fred W. Balke, Crestwood, Ky. ; part interest to each

[21] Appl. No.: 48,841

[22] Filed: Jun. 15, 1979

[51] Int. Cl.[3] ..... E01C 7/24; E01C 19/10

[52] U.S. Cl. ..... 404/72; 404/91; 404/92; 106/283; 366/7; 366/12; 366/54

[58] Field of Search ..... 404/83, 77, 91, 79, 404/92, 80, 72; 366/7, 12, 54; 106/283, 281 R

[56] References Cited

U.S. PATENT DOCUMENTS

| | | | |
|---|---|---|---|
| 785,650 | 3/1905 | Amies | 106/283 |
| 935,573 | 9/1909 | Amies | 106/283 |
| 1,205,948 | 11/1916 | Popkess | 404/91 |
| 1,240,481 | 9/1917 | Popkess | 404/83 X |
| 1,369,730 | 2/1921 | Daniel | 404/83 |
| 1,456,492 | 5/1923 | Hepburn | 106/283 |
| 1,570,028 | 1/1926 | Amies | 106/283 |
| 1,774,649 | 9/1930 | Hepburn | 404/83 X |
| 2,069,376 | 2/1937 | Madsen | 404/92 |
| 2,257,637 | 9/1941 | Moore | 404/95 X |
| 2,338,166 | 1/1944 | Dahlberg | 106/283 |
| 2,394,017 | 2/1946 | Seaman | 404/95 |
| 2,413,908 | 1/1947 | Chester | 404/92 |
| 2,619,013 | 11/1952 | McEachran | 404/92 |
| 3,843,274 | 10/1974 | Gutman | 404/91 |
| 4,011,023 | 3/1977 | Cutler | 404/91 |

*Primary Examiner*—Nile C. Byers, Jr.

*Attorney, Agent, or Firm*—Maurice L. Miller, Jr.

[57] ABSTRACT

A process for rejuvenating and recycling used asphalt and a machine including a pugmill mixing chamber for mixing crushed asphalt supplied thereto and for mixing water, calcium oxide and asphalt oil therewith is disclosed. The water and calcium oxide mixture react and chemically combine to form a calcium hydroxide filler material to thus fill the voids and gaps in the rejuvenated asphalt that would otherwise exist. The reaction, being exothermic, increases the temperature of the resultant asphalt based mixture to a level suitable for spreading of the rejuvenated material on a prepared surface. The asphalt oil is preferably preheated using a heat exchanger coil connected to a diesel engine radiator, which coil is immersed in an asphalt oil storage tank carried on the machine so that the viscosity of the oil may be reduced to a reasonable value suitable for pumping to the mixing chamber and spraying on the materials contained therein. A storage bin for storing granulated calcium oxide is positioned above the pugmill mixing chamber and contains an elongated opening in the bottom surface thereof which allows the bin to communicate with the chamber. A cylindrically shaped rotatable metering device is positioned at the bottom of the bin over the opening and contains a series of elongated axially extending slots radially displaced around the metering device so that the slots carry a measured quantity of calcium oxide from the bin into the chamber through the opening as the device is rotated, the speed of rotation of the device thus determining the rate at which material from the bin is introduced into the chamber.

21 Claims, 8 Drawing Figures

METHOD AND APPARATUS FOR REJUVENATING AND RECYCLING ASPHALT

BACKGROUND OF THE INVENTION

This invention relates generally to machines and processes for rejuvenating crushed asphalt removed, as with a milling machine, from a previously paved surface, and for recycling such rejuvenated asphalt back to the same surface from which it was removed or, otherwise, back to another prepared surface.

Vehicle for removing said reclaiming asphalt from a previously paved surface and returning same to the surface from which it was taken are, generally speaking, well known in the prior art. See, for example, U.S. Pat. No. 3,843,274 issued to Nathan Gutman, et al. on Oct. 22, 1974 entitled "Asphalt Reclaimer" wherein a machine employing a means for heating the upper layer of asphalt, a rotary cutter for lifting the heated asphalt, a pugmill for pulverizing the lifted asphalt, a spreader for redistributing the pulverized asphalt and a leveler is disclosed. This apparatus employs a propane gas storage tank to supply fuel to a series of heaters including an infra red heater to heat the road surface immediately prior to removal of asphalt with the rotary cutter, a heater to heat the pugmill, and a heater associated with a vibrator type of spreading means.

See also U.S. Pat. No. 4,011,023 issued to Earl F. Cutter on Mar. 8, 1977 on "Asphalt Paving Recycling Apparatus" which discloses a machine for removing crumbled pavement from a roadway, which machine contains a heater for preliminarily heating the crumbled material removed from a pavement, another heater for heating liquid asphalt being added to the crumbled material and a series of radiant heaters for raising the temperature of the crumbled material and asphalt mix to lower its viscosity. Additional roadbed heaters are also employed to raise the temperature of the roadbed site upon which the recycled asphalt is to be applied.

See also U.S. Pat. No. 2,394,017 issued to H. J. Seaman on Feb. 5, 1946 entitled "Road Building Machine" which discloses an apparatus for gathering asphalt from a roadway, a burner for passing over the loosened surface material for heating the same, a mixer for throwing the material against the walls of the mixing chamber to pulverize the same, and a sprayer for adding a liquid binder to the pulverized material.

One difficulty that has been encountered using such prior art asphalt recycling machines and methods is the necessity of providing expensive fuel for the various heaters and burners employed to raise the temperature of the crumbled asphalt. This difficulty is compounded by the increasing cost and scarcity of such fuels under present day conditions.

Moreover, the processes employed by these prior art machines merely add asphalt oils back to the crumbled material as a binder to restore the bondable nature of the asphalt which has been lost due to the volatilization or evaporation of the oil originally contained in the asphalt when originally laid.

By means of the machine and process of our invention, we substantially overcome these and other difficulties encountered in the prior art.

SUMMARY OF THE INVENTION

It is an object of our invention to provide a machine for receiving crushed asphalt previously removed from a roadway which rejuvenates and restores the asphalt for reapplication to a prepared roadbed surface.

It is another object of our invention to provide a process for rejuvenating asphalt by additions of water and calcium oxide thereto to increase the temperature of the mixture to a suitable respreading temperature exothermically, and without the necessity of using heaters which employ fuel from an external source to raise the temperature thereof to a level suitable for respreading.

It is yet another object of our invention to provide a machine and process for rejuvenating asphalt previously removed from a paved surface by addition thereof of a calcium hydroxide filler to fill the gaps and voids that would otherwise exist therein to enhance the quality of the rejuvenated material.

It is still another object of our invention to provide a machine for rejuvenating asphalt adapted to employ either a continuous or batch mixing process as desired.

It is also an object of our invention to provide a machine for rejuvenating asphalt which is adapted to be used in association with other readily available road-building machines such as milling machines, pavers and rollers to form a continuous asphalt roadway recycling process.

Briefly, in accordance with our invention, we provide a process for recycling asphalt, the steps of which include providing a quantity of crushed asphalt previously removed from a paved surface. Next, the crushed asphalt is mixed with a quantity of water and a quantity of calcium oxide to raise the temperature of the resultant mixture exothermically and to provide a calcium hydroxide filler for the crushed asphalt. Next, a quantity of asphalt oil is mixed with the resultant mixture to form a bondable asphalt-based compound. Finally, the compound is applied to a prepared surface after the temperature of the compound has increased to a suitable reapplication temperature.

These and other objects of our invention will become apparent to those skilled in the art from the following detailed description and attached drawings upon which, by way of example, only the preferred embodiments of the subject invention are illustrated.

DESCRIPTION OF THE PREFERRED EMBODIMENTS

Figure 1:
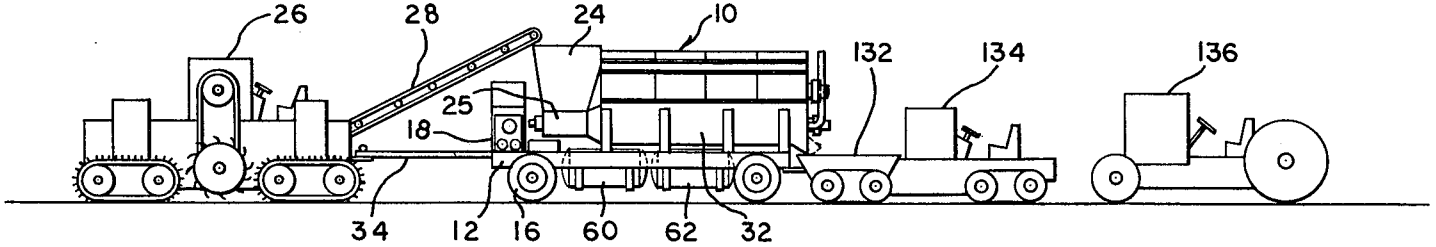
FIG. 1 shows a side elevation view of a series of machines operating in tandem according to the process of our invention, illustrating one preferred embodiment of our invention.
Figure 2:
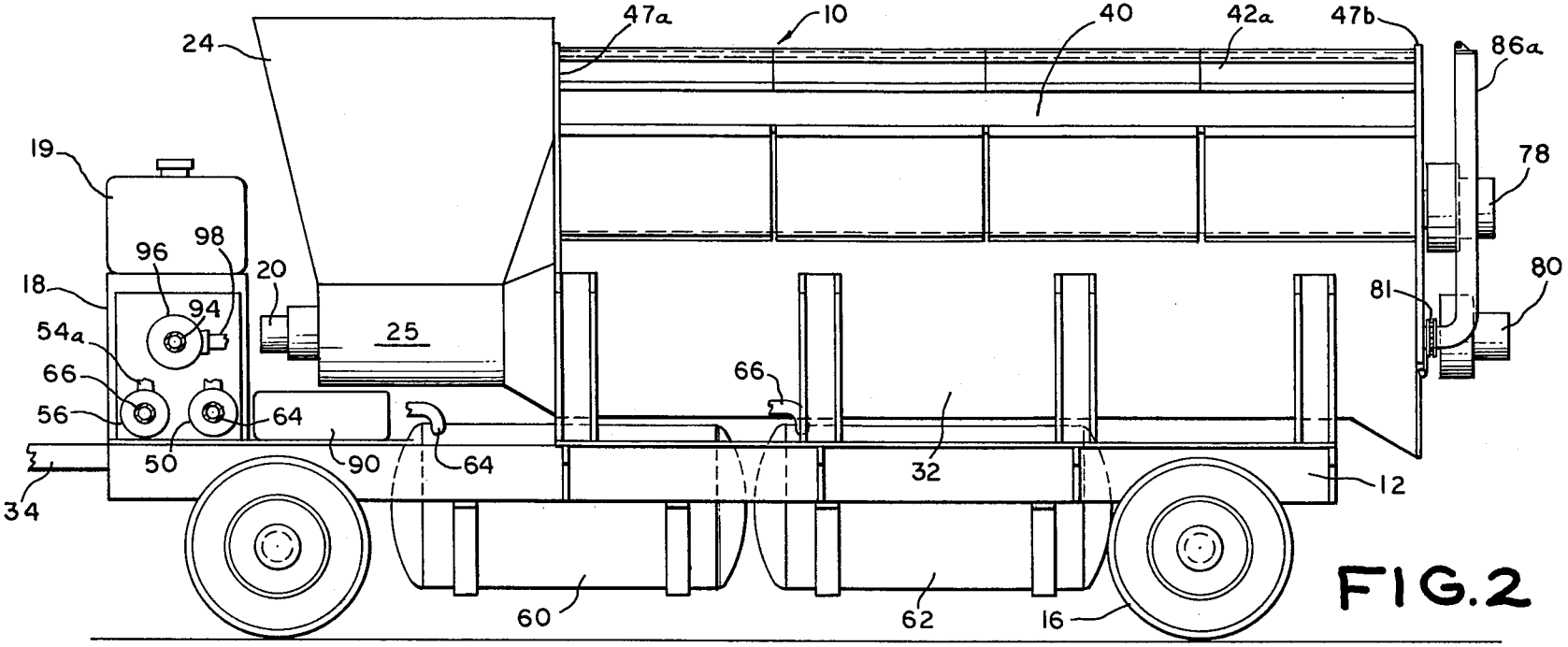
FIG. 2 shows a side elevation view of an asphalt rejuvenating machine illustrating another preferred embodiment of our invention.
Figure 3:
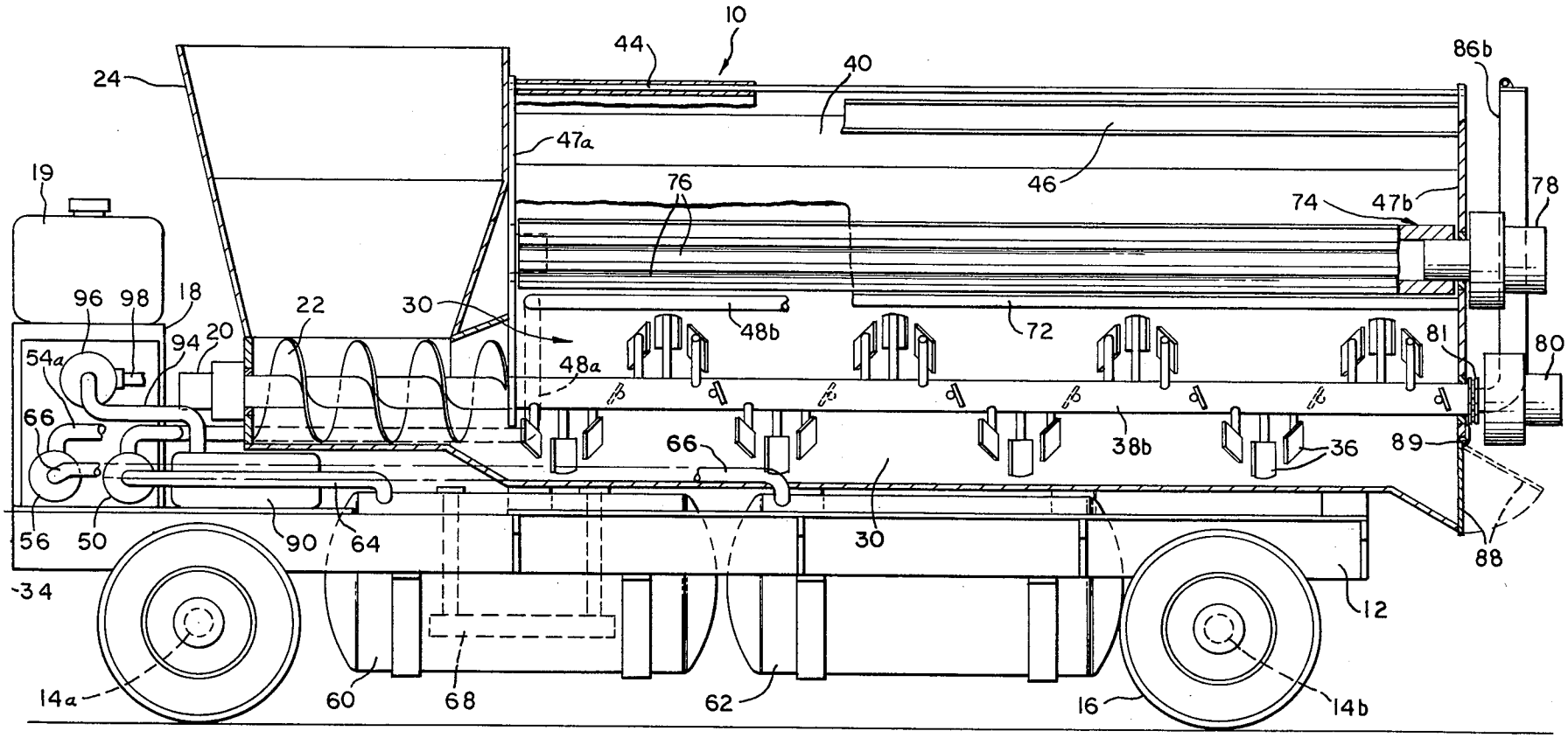
FIG. 3 shows a cut-away side elevation view of the machine of FIG. 2, thus exposing certain interior components.
Figure 4:
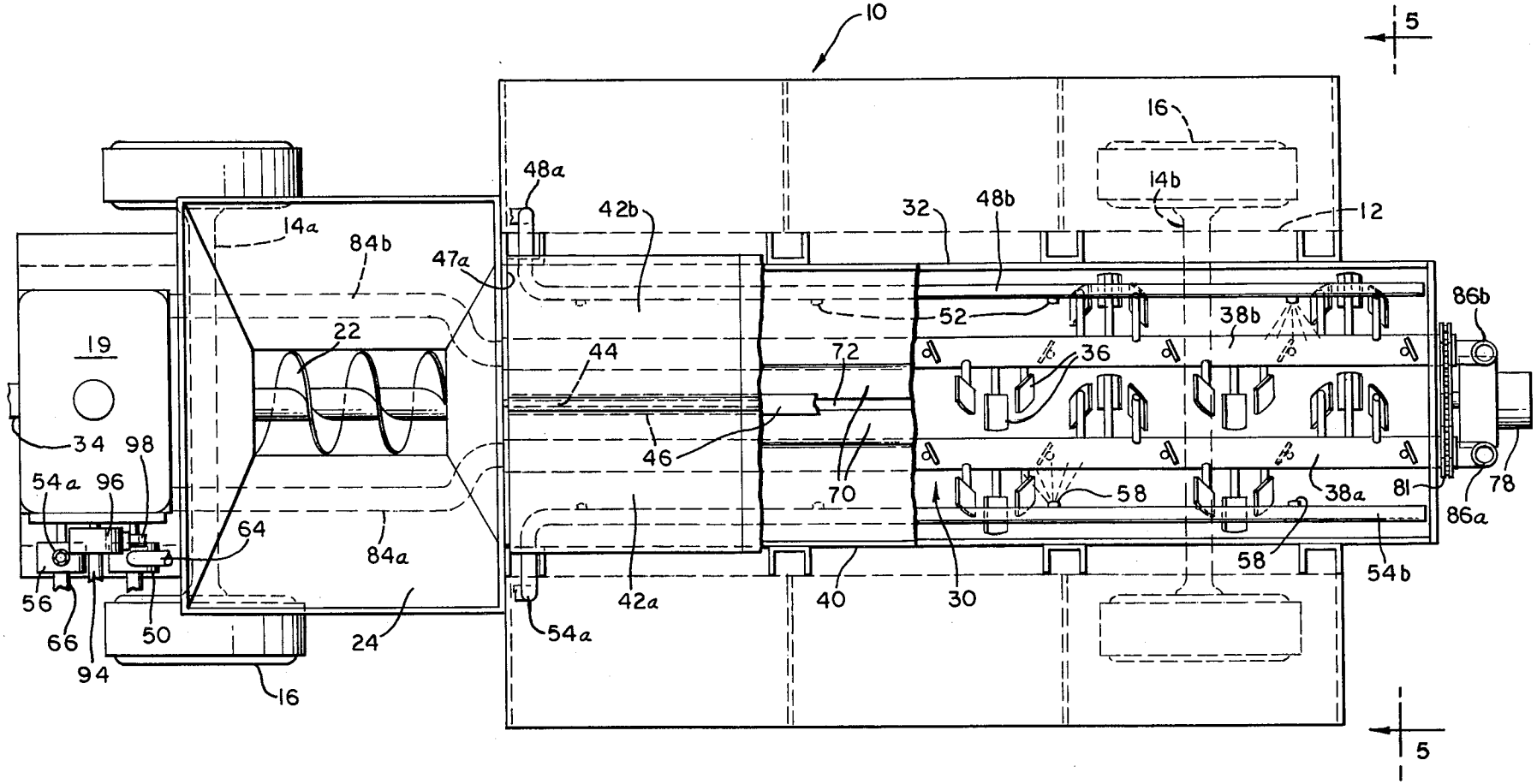
FIG. 4 shows a partial cut-away plan view of the machine of FIGS. 2–3, thus exposing certain interior components.
Figure 5:
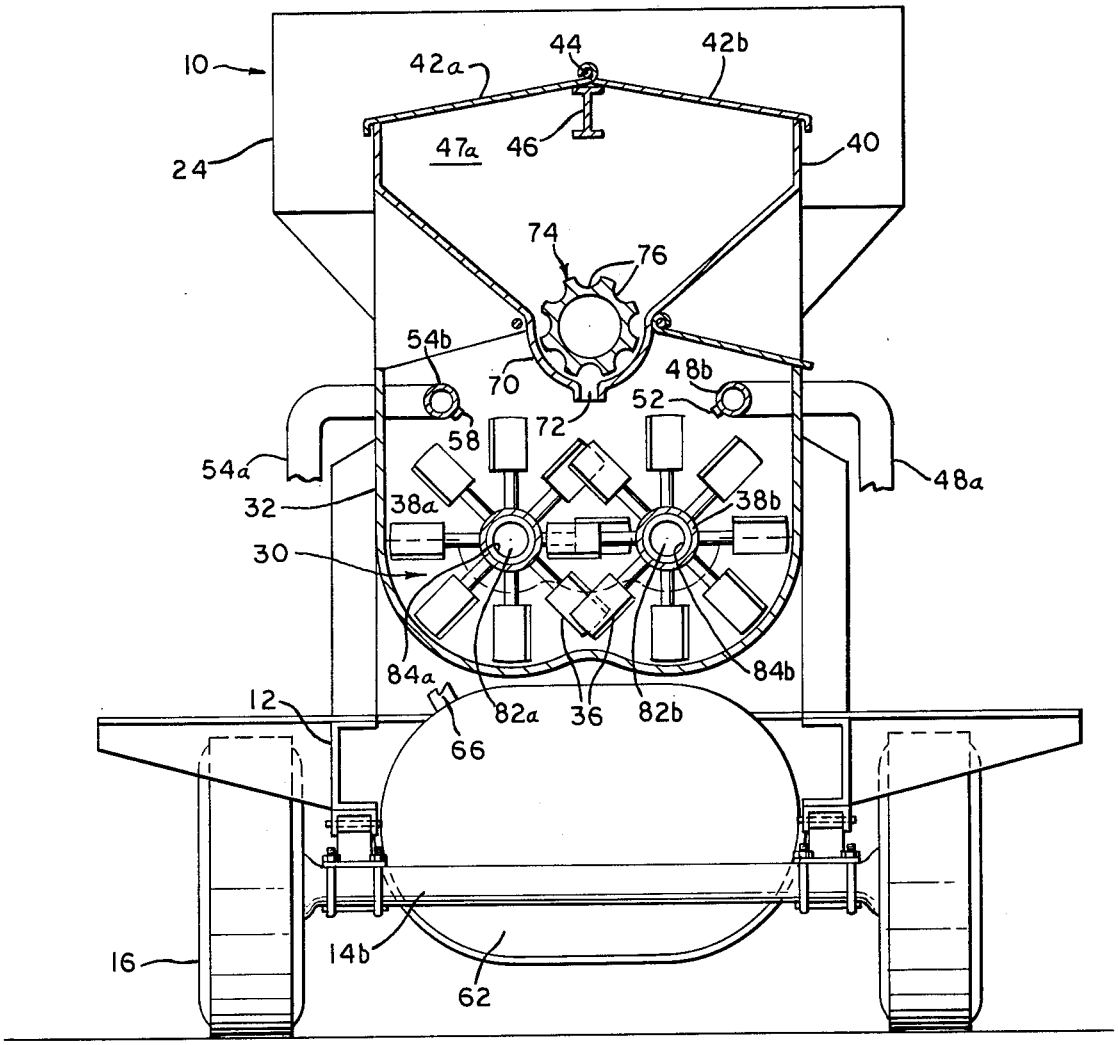
FIG. 5 shows a cut-away rear elevation view of the machine of FIGS. 2–4, thus exposing certain interior components.

Referring now to the drawings, there is shown a vehicularized pugmill mixing machine 10 for use in a process for recycling asphalt. The machine 10 is provided with a frame 12, front and rear axles 14*a, b* and wheels 16 for movement along a roadway, roadbed, parking lot or other prepared surface. An engine 18 of conventional type such as a diesel, for example, and a fuel tank 19 is mounted on a forward end portion of the frame 12 to provide hydraulic driving fluid, under pressure, for operating a series of hydraulic motors including a motor 20 used to turn an auger 22 located at the bottom of an open top hopper 24 and disposed within a housing 25. Crushed asphalt milled from the surface of a roadway by a conventional milling machine 26 is transferred by a belted conveyor 28 to the open top of the hopper 24 wherein the material is dumped as shown in FIG. 1. The crushed asphalt material deposited in the hopper 24 is thus conveyed by means of the auger 22 rearwardly along the vehicle frame into a pugmill mixing chamber 30 enclosed within a housing 32. The vehicle 10 may be self-propelled by means of the engine 18, or, as in the present example, may be towed by another powered vehicle such as the milling machine 26 by means of a tongue 34 as indicated in FIG. 1.

The crushed asphalt material, conveyed by means of the auger 22 into the forward end of the pugmill mixing chamber 30, is presented to a pulverizing means consisting of a series of paddles or blades 36 radially disposed around and along a pair of elongated cylindrically-shaped rotatable members 38*a,b* and placed at an angle with respect to the members 38*a,b* such that, as the blades 36 rotate, the crushed asphalt material is moved toward the rear end of the chamber 30. Along and above the mixing chamber 30, there is provided a storage bin 40 enclosed along its top by a pair of lids 42*a,b* hingably connected to an elongated rod or pin 44. The hingable portion of the lids 42*a,b* rests upon an I-beam supporting member 46. The member 46 is connected between front and rear walls 47*a,b* forming the forward and rear ends of chamber 30 and bin 40. An oil line 48*a* connected to an oil pump 50 on the engine 18 extends to a connection with an oil line or spray bar 48*b*, the latter extending along the length of the pugmill mixing chamber 30 along one side thereof and containing spaced nozzles 52 for spraying preheated asphalt oil downwardly onto the material being mixed by the blades 36 in the chamber 30. A water line 54*a* connected to a water pump 56 on the engine 18 extends to the mixing chamber 30 where it connects to a water spray bar 54*b* which is disposed along the length of the mixing chamber 30, along the other side thereof, and contains spaced nozzles 58 for spraying water downwardly onto the material being mixed by the blades 36. Asphalt oil and water storage tanks 60 and 62, respectively, are carried on the frame 12 under the mixing chamber 30. Oil flows from the tank 60 to the oil pump 50 through a pipe 64 while water flows from the tank 62 to the water pump 56 through a pipe 66. The asphalt oil is preferably preheated by means of conventional hot water pipes forming a heat exchanger coil 68 immersed in the oil tank 60 so that the oil viscosity may be reduced to enhance its mixing with the other materials in the chamber 30.

The storage bin 40 is adapted for storage of a quantity of calcium oxide or quick lime. The sides of the bin 40 slope downwardly toward a semi-cylindrical base 70 containing an elongated slit or opening 72 in the bottom thereof through which the calcium oxide may fall into the mixing chamber 30 along the entire length thereof. A rotatable elongated cylindrically-shaped metering device 74 is disposed at least partially within the semi-cylindrical base 70 and contains a series of axially extending slots 76 radially disposed thereon. A hydraulic motor 78, dispsoed on the back of the machine 10 and driven by the engine 18, in turn, drives the metering device 74 to meter the desired amount of calcium oxide through an opening 72 and into the chamber 30 to produce an exothermic reaction wherein the materials being mixed in the chamber 30 will undergo a temperature increase as the calcium oxide reacts with the water saturated crushed asphalt. As a result of the reaction of the calcium oxide with the water, a calcium hydroxide filler material is formed within the crushed asphalt which serves to fill voids and spaces that would otherwise exist in the reconditioned asphalt. The rotatable members 38*a,b* of the pubmill are driven by a hydraulic motor 80 which also receives driving fluid from the engine 18 through a suitable gear train 81.

The rotatable members 38*a,b* contain hollow cylindrical shafts 82*a,b* centered on their axes which are connected by a pair of pipes 84*a,b* to the exhaust manifold of the engine 18 so that the hot exhaust gases emitted from the engine 18 can be efficiently utilized to help heat the mixing chamber 30 to aid the ongoing exothermic reaction taking place therein. Upon reaching the rear ends of the shafts 82*a,b*, the hot engine exhaust gases are vented to atmosphere through vertically-extending exhaust pipes 86*a,b* mounted on the rear wall 47*b* and connected to the ends of the rotating members through suitable and well known rotating heat seals. In the alternative, the lower ends of the exhaust pipes 86*a,b* may simply be inserted into the rear ends of the shafts 82*a,b* and securely supported so that the shaft defining walls may rotate about the ends of the pipes 86*a,b* without rubbing or touching them. The asphalt based compound containing a calcium hydroxide filler and asphalt oil mixed and formed in the pugmill chamber 30 is transferred by action of the rotating blades 36 to the rear end of the chamber 30 where it is passed out of the machine 10 through a gate 88 connected by means of a hinge 89 to the rear wall 47*b*.

Figure 6:
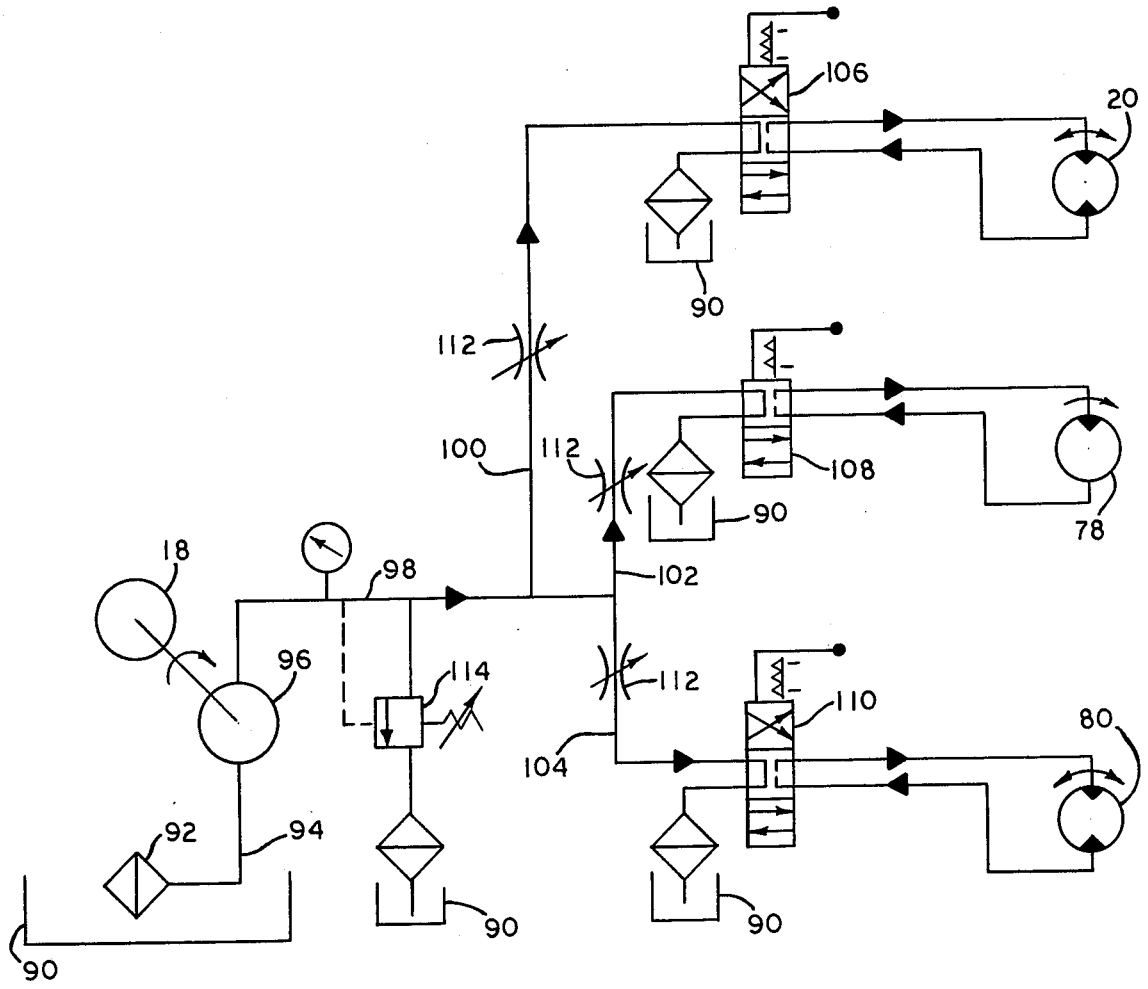
FIGS. 6–8 show schematic diagrams of the main hydraulic drive system, the preheated asphalt oil pumping system, and the water spraying system, respectively, of the machine of FIGS. 2–5.

Referring now particularly to FIG. 6, the main hydraulic drive system for the machine 10 is shown which includes a reservoir 90 for storing a quantity of hydraulic oil. The oil is pumped from the reservoir 90 through a suitable filter 92 and into a line 94 and a hydraulic pump 96, the latter being located on and driven by the engine 18. The pump 96 delivers hydraulic oil from its high pressure output port into a line 98 and thence into branch lines 100, 102 and 104 to supply driving fluid through control valves 106, 108 and 110, respectively, to the auger drive motor 20, the calcium oxide metering device drive motor 78, and the pugmill drive motor 80, respectively. The valves 106 and 110 are of the standard reversible type to permit the operator of the machine 10 to reverse the direction of operation of the auger motor 20 and the pugmill motor 80 to reverse the operation of the auger 22 and the members 38*a,b* as desired. Adjustable flow control valves 112 are located in each of the branch lines 100, 102 and 104. The valve 108 for operation of the metering device drive motor 78 may be of the standard two-position, on/off type since there is no need for reversing the direction of rotation of the metering device 74. When any of the valves 106, 108 and 110 are placed in the closed position as shown in FIG. 6, oil in the branch lines being fed thereto is shunted back to the tank 90 (shown in FIG. 6 as a series of separate tanks, each designated by the same numeral 90 for convenience) so that a continuous circuit for the flow of hydraulic oil will be maintained as long as the pump 96 is running, regardless of whether any of the motors 20, 78 or 80 are operative. Lastly, a standard oil pressure relief valve 114 is connected to the main line 98 to shunt oil back to the tank 90 should the oil pressure rise to an unsafe level.

Figure 7:
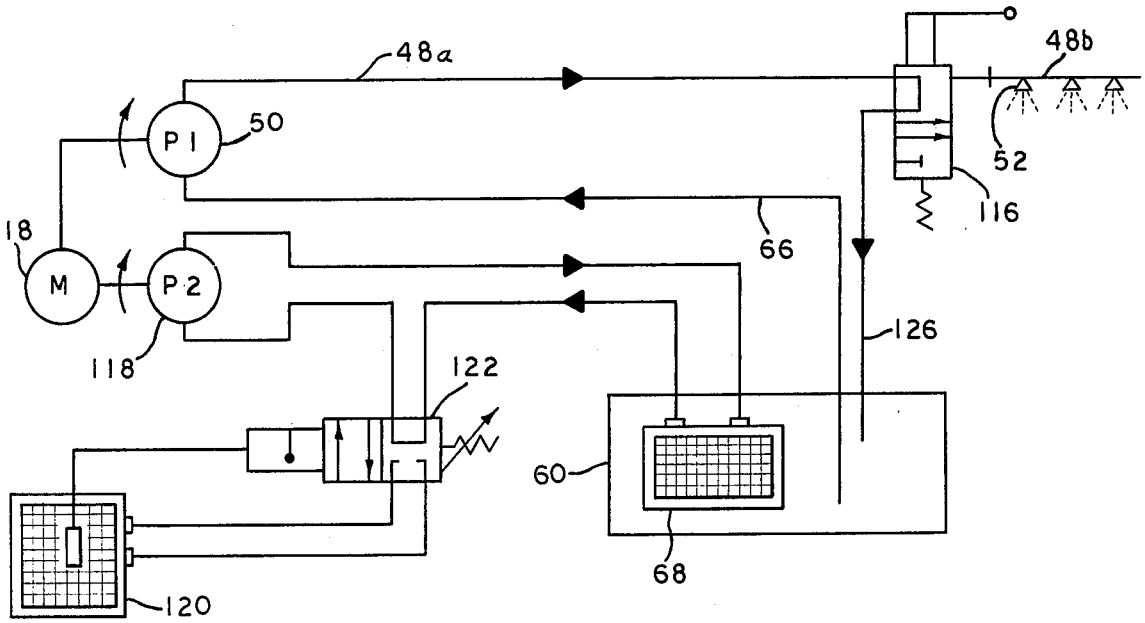

Referring now to FIG. 7, the asphalt oil pumping system contained in the machine 10 is shown wherein the engine 18 drives the asphalt oil pump 50 to supply asphalt oil from the tank 60 through the line 66 to the pump 50. High pressure asphalt oil is supplied by the pump 50 into the line 48*a* and to a normally closed two-position control valve 116 and, thereafter upon command, to the nozzles 52 where it is sprayed upon the material being mixed in the pugmill chamber 30. To preheat the asphalt oil so as to reduce its viscosity to a reasonable level for spraying and mixing effectively with the materials in the chamber 30, the engine 18 also drives a water pump 118 which circulates hot water from a radiator 120 of the engine 18 through a standard normally closed, two-position, water temperature control valve 122 to the heat exchanger coil 68 disposed in the asphalt oil storage tank 60 so as to be immersed within the stored oil. When the oil spray bar 48*b* of the pugmill is not in use, the oil control valve 116 is in its normally closed state as shown in FIG. 7, wherein asphalt oil flowing through the line 48*a* is shunted by the valve 116 back to the storage tank 60 through a line 126 so as to assure the constant circulation of oil through the pump 50 at all times while the latter is running.

Figure 8:
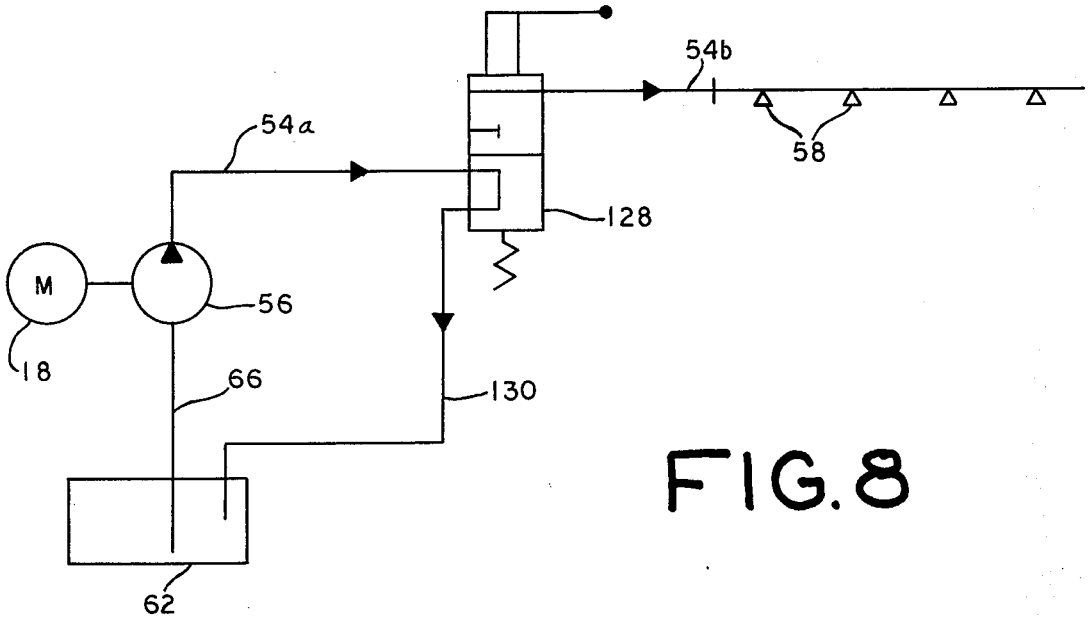

Referring now to FIG. 8, there is shown, in a diagram of the water spray system of the machine 10, the engine 18 driving the water pump 56 to draw water from the storage tank 62 and supply the same through the line 66 and into the line 54*a* to a standard normally closed two-position control valve 128. Upon command, the valve 128 is shifted to its open state to permit water to flow from the line 54*a* into the line or water spray bar 54*b* located in the mixing chamber 30 to be sprayed from the nozzles 58. When the valve 128 is disposed in its normally closed state as shown in FIG. 7, the valve 128 shunts water from the line 54*a* back to the storage tank 62 through a line 130 to maintain water circulation through the pump 56 at all times while the latter is running, regardless of whether the spray bar 54*b* is in use.

The mixing machine 10 of the present example is readily adaptable for use in either a continuous or batch mixing process. For example, where it is desired to resurface only a small section of roadway or fill a limited number of holes, the hopper 24 may be loaded with a fixed quantity of crushed asphalt previously removed from a roadway, and the bin 40 may be loaded with a fixed quantity of granulated calcium oxide. Thereafter, the auger 22 is operated to convey the crushed asphalt from the hopper 24 into the pugmill mixing chamber 30, and the members 38*a,b* are rotated so that the blades 36 commence agitating and mixing the crushed asphalt. As the asphalt is being transferred into the mixing chamber 30 and while the members 38*a,b* continue to rotate, the water pump 56 is activated to spray water from the pipe 54*b* onto the agitating asphalt particles to saturate them. After the crushed asphalt has been approximately fully saturated with water, the water pump 56 is de-activated and the motor 78 is energized to rotate the metering device 74 to transfer the calcium oxide from the bin 40 into the chamber 30 there to become mixed in the agitating, water saturated, crushed asphalt to react with the water to form a calcium hydroxide filler material in the asphalt and produce a temperature increase in the resultant mix exothermically. After the desired quantity of calcium oxide has been metered into the chamber 30 and mixed with the saturated asphalt, the oil pump 50 is activated to spray hot oil into the agitating mix to produce a self-bonding or bondable, asphalt-based compound. Thereafter, as the temperature of the compound rises, the gate 88 at the lower rear end of the chamber 30 is opened to allow the rotating blades 36 to feed the compound out of the chamber 30 and into a hopper 132 associated with a conventional asphalt spreading apparatus 134. The spreading apparatus 134 may thereafter be driven behind the machine 10 as shown in FIG. 1 or driven to other locations remote with respect to the machine 10 to spread the rejuvenated asphalt compound in the usual, conventional and well known manner.

The machine 10 is also adapted for use in a continuous mixing process wherein it is towed behind the milling machine 26 and wherein the hopper 24 receives crushed asphalt from the milling machine 26 along the conveyor 28 continuously as the machine 26 moves forward along a paved surface, all as shown in FIG. 1. In such a continuous mixing operation, crushed asphalt is continuously fed by the auger 22 into the mixing chamber 30 and the blades 36 rotate continuously to further mix the crushed asphalt and transfer it rearwardly toward the gate 88 at a more or less constant rate of speed. During such a continuous mixing process, the nozzles 58 along the rear two-thirds of the length of the chamber 30 are capped or otherwise sealed or plugged so that only those nozzles 58 along the forward one-third of the length of the water spray bar 54*b* are operative. Water is sprayed continuously from the operative nozzles 58 so that, as the crushed asphalt reaches the middle one-third of the chamber 30, it is essentially fully saturated. The metering device 74 also operates continuously, however, calcium oxide is metered from the bin 40 downwardly into the chamber 30 only along the middle one-third of the length thereof so that it reacts immediately with the water saturated asphalt as it is mixed therewith. If calcium oxide were metered into the asphalt along the forward one-third of the length of the chamber 30, some mixing would occur with asphalt not yet fully saturated with water such that the exothermic reaction would be delayed with a consequent loss of efficiency. A pair of plates conforming to the cross-section of the bin 40 may be disposed therein at positions one-third and two-thirds of the distance from the front of the chamber 30 to assure that the calcium oxide will fall through the opening 72 into the chamber 30 only along the central one-third of the length thereof. The nozzles 52 located along the forward two-thirds of the length of the chamber 30 are capped or plugged so that hot oil can be sprayed into the chamber 30 during a continuous mixing operation only along the rearmost one-third length portion thereof. The hot oil should at least have a temperature which is at or near the maximum temperature which the resultant mixture is intended to reach for proper spreading, to avoid inhibiting the exothermic temperature increase thereof. Another reason for preheating the asphalt oil in the tank 60 is to decrease its viscosity and increase its flowability so as to render the oil readily sprayable using an oil pump 50 of reasonable size and so as to assure uniform mixing of the oil in the asphalt based hydrated lime compound over the relatively short mixing distance and time involved.

As shown in FIG. 1, the mixing machine 10 is thus readily adaptable for use in a continuous asphalt recycling process wherein milled asphalt is continuously supplied by the milling machine 26 rearwardly along the conveyor 28 to the hopper 24 of the pugmill mixing machine 10 as the milling machine 26 moves forwardly along a roadway or other paved surface. The continuous mixing process takes place in the chamber 30 of the machine 10 as previously described as the machine 10 is towed behind the machine 26, after which reconditioned asphalt containing a calcium hydroxide filler with new oil added is delivered rearwardly from the gate 88 into the hopper 132 of the conventional asphalt spreader 134. The spreader 134 spreads the reconditioned asphalt after the rejuvenated material has reached an elevated temperature sufficient for reapplication to the roadway or other paved surface by conventional techniques, i.e. at least about 140 degrees F., although a somewhat lower temperature may be found to be satisfactory under proper circumstances. We believe the exothermic reaction and asphalt oil temperature should be adjusted so that the reconditioned asphalt may be spread at temperatures ranging between about 100°–180° F. for best results although other spreading temperatures may be found equally satisfactory. A conventional roller 136 may be employed in the usual, well known manner to follow behind the spreader 134 to press the reconditioned asphalt following its application to the prepared surface.

It will be appreciated by those skilled in the art that the machine 10 of the subject example could readily be made a self-propelled vehicle if desired. The chamber 30 should contain insulated walls 32 for best results such that as much of the heat generated by the hydration of the calcium oxide as practical can be retained. The rotatable members 38*a,b* upon which the blades 36 are mounted can be adapted to rotate in the same or in opposite directions as desired. Our experiments indicate that it is best to add just enough water to the crushed asphalt at the beginning of the mixing process as necessary to fully saturate the asphalt and no more. Adding more water than necessary to saturate the asphalt will produce liquid run-off which is wasteful and for which provision must be made to carry off the excess. We have found that water added to dry crushed asphalt in the ratio of about 0.06:1.00 by weight is about optimum, although this ratio may be reduced somewhat where the milling machine 26 employs a water spray to moisten the asphalt being removed from a paved surface as is often done to eliminate dust. Adding a lesser amount of water will permit the exothermic reaction to occur after the calcium oxide is added, but with reduced efficiency. At such a ratio of water to crushed asphalt, we have further found by experimentation that an excellent exothermic reaction can be obtained by adding from about 5.0 to 10.0 pounds of calcium oxide to the saturated asphalt for each 100 pounds of dry crushed asphalt so saturated. Adding much more calcium oxide than this amount will result in a portion of the oxide not becoming hydrated and thus not contributing to the desired exothermic temperature increase while resulting in a wasteful and unnecessary use of lime. By addition of much less than this amount of lime to the water saturated asphalt, the quantity of water adhering to the asphalt will not be fully combined chemically therewith so that the highest exothermic temperature increase possible will not be obtained. We have also found that the resultant calcium hydroxide mixed in the crushed asphalt makes an excellent filler for the voids and spaces which would otherwise exist in the rejuvenated asphalt were the lime not used. A number of asphalt oils are commonly available and used in forming and rejuvenating asphalt, all of which we believe will work well in our recycling process. We have tested emulsified asphalt oils such as AE 200, MS 2 and R 52 all with excellent results although we believe that of these three varieties, AE 200 will produce the best results in most cases. Other asphalt oils of either the emulsified or unemulsified varieties may also be used in the process. The oil mixing operation of the machine 10 should take about 30 seconds in order that the blades 36 have sufficient time to agitate and thoroughly mix the oil with the asphalt based, hydrated lime compound. In this manner, the oil previously volatilized from the oil asphalt is replaced and a suitably bondable, rejuvenated asphalt based compound is obtained. We believe that, by using our process to rejuvenate old asphalt, up to 80 percent less oil by weight is needed than is required to produce the same mass of new asphalt material. The amount of asphalt oil to be used in our process will normally range from about 5 to 15 pounds for each 100 pounds of dry crushed asphalt with which the oil is to be mixed, depending upon the grade of oil used and the quality of the crushed asphalt employed, although departures from this range may be found satisfactory in some cases.

Although the subject invention has been described with respect to specific details of certain preferred embodiments thereof, it is not intended that such details limit the scope and coverage of our invention otherwise than as set forth in the following claims.

We claim:

1. A process for recycling asphalt, the steps of which comprise (A) providing a quantity of crushed asphalt previously removed from a paved surface, (B) mixing said quantity of crushed asphalt with a quantity of water to provide an intermediate mixture, and, thereafter (C) mixing a quantity of calcium oxide with said intermediate mixture to form a resultant mixture, (D) mixing a quantity of asphalt oil with said resultant mixture to form a bondable, asphalt based compound, and (E) applying said compound to a prepared surface after the temperature of said compound has reached a level suitable for such application.

2. The process of claim 1, the steps of which further comprise preheating said quantity of asphalt oil prior to step (C) to improve the flowability and mixing of said oil with said resultant mixture.

3. The process of claim 1 wherein said quantity of water is at least sufficient to saturate said quantity of crushed asphalt.

4. The process of claim 1 wherein the ratio of said quantity of water to said quantity of crushed asphalt is at least 0.06:1.00 by weight.

5. The process of claim 1 wherein the ratio of said quantity of calcium oxide to said quantity of crushed asphalt is within the range of from about 5% to 10% by weight.

6. A process for recycling asphalt, the steps of which comprise (A) milling asphalt from a paved surface to provide a quantity of crushed material, (B) conveying said crushed material to a mixing chamber, (C) mixing a quantity of water with said quantity of crushed material to form an intermediate mixture, (D) mixing a quantity of calcium oxide with said intermediate mixture to produce an exothermic reaction to raise the temperature of the resultant mixture and to form a calcium hydroxide filler in said crushed material, (E) preheating a quantity of asphalt oil to reduce the viscosity thereof, (F) mixing said quantity of preheated asphalt oil with said resultant mixture to form a bondable, asphalt-based compound, and (G) applying said compound to a prepared surface after the temperature of said compound has reached a level suitable for such application.

7. The process of claim 6 wherein said quantity of water is at least sufficient to saturate said quantity of crushed material.

8. The process of claim 7 wherein said temperature level is at least 100 degrees F.

9. An apparatus for rejuvenating crushed asphalt comprising hopper means for receiving a quantity of crushed asphalt therein, first mixing means defining a mixing chamber for mixing said crushed asphalt with other materials and for moving materials introduced therein toward one end of said chamber, means for transporting crushed asphalt from said hopper means into said mixing chamber, storage means disposed above said first mixing means and communicating with said mixing chamber, means for metering a quantity of material stored in said storage means into said mixing chamber at a selected rate, second mixing means disposed in said mixing chamber for mixing a quantity of water with said crushed asphalt to saturate the latter, third mixing means disposed in said mixing chamber for mixing a quantity of asphalt oil with said crushed asphalt, and means for ejecting said materials from said one end of said chamber.

10. The apparatus of claim 9 further comprising vehicularizing means rendering said apparatus mobile.

11. The apparatus of claim 10 wherein said first mixing means comprises a pugmill.

12. The apparatus of claim 10 wherein said transporting means comprises an auger.

13. The apparatus of claim 10 wherein said storage means comprises a bin extending along an upper surface of said first mixing means and defining sidewalls sloping inwardly and downwardly toward a vertical plane extending through said mixing chamber containing the centerline thereof, a lower surface of said bin defining a longitudinally extending opening through which said bin communicates with said chamber.

14. The apparatus of claim 10 wherein said second and third mixing means comprise an elongate water spray bar disposed along one side of said chamber and an elongate oil spray bar extending along the other side of said chamber, each of said bars containing a series of spray nozzles spaced from one another along the lengths thereof.

15. The apparatus of claim 10 wherein said ejecting means comprises a gate hingably attached to a rear wall of said first mixing means, said gate covering an opening formed through said wall.

16. The apparatus of claim 10 further comprising means for preheating said asphalt oil prior to mixing said oil with said crushed asphalt.

17. The apparatus of claim 10 further comprising a hydraulic motor for driving said transporting means, a hydraulic motor for driving said first mixing means, a hydraulic motor for driving said metering means, a first pump for supplying water to said second mixing means, a second pump for supplying asphalt oil to said third mixing means, an engine operatively connected to said motors and pumps, a first storage tank for storing a quantity of said water and connected to said first pump, and a second storage tank for storing a quantity of said asphalt oil and connected to said second pump.

18. The apparatus of claim 13 wherein a lower portion of said sidewalls forms a semi-cylindrical space, said metering means comprising an elongate, generally cylindrical rotatable element defining a series of longitudinally extending slots radially disposed around said element, whereby each of said slots registers with said opening once during each complete rotation of said element.

19. The apparatus of claim 17 further comprising a heat exchanger disposed in said second storage tank for heating said quantity of asphalt oil.

20. The apparatus of claim 19 further comprising a radiator connected to said engine, and means for circulating hot water between said radiator and heat exchanger upon command.

21. The apparatus of claim 20 wherein said circulating means comprises a temperature control valve responsively connected to said radiator and adapted to supply hot water from said radiator to said heat exchanger, and a third pump responsively connected to said engine and operatively connected to said radiator and heat exchanger to circulate water between said heat exchanger and pump when said control valve is in a closed state and for circulating water between said radiator, pump and heat exchanger when said control valve is in an open state.

* * * * *